US009415244B2

(12) United States Patent
Cazzaro et al.

(10) Patent No.: US 9,415,244 B2
(45) Date of Patent: Aug. 16, 2016

(54) ROPE ASCENDER DEVICE AND METHOD FOR USE THEREOF

(75) Inventors: Michele Cazzaro, Besozzo (IT); Andrea Merello, Genoa (IT)

(73) Assignee: Harken Italy S.P.A., Limido Comasco (Como) (IT)

( * ) Notice: Subject to any disclaimer, the term of this patent is extended or adjusted under 35 U.S.C. 154(b) by 411 days.

(21) Appl. No.: 13/498,684

(22) PCT Filed: Jun. 1, 2010

(86) PCT No.: PCT/IB2010/001313

§ 371 (c)(1),
(2), (4) Date: Nov. 20, 2012

(87) PCT Pub. No.: WO2011/036520

PCT Pub. Date: Mar. 31, 2011

(65) Prior Publication Data

US 2013/0056695 A1 Mar. 7, 2013

(30) Foreign Application Priority Data

Sep. 28, 2009 (IT) ..... MI2009A1656

(51) Int. Cl.

| | |
|---|---|
| ***B66D 3/04*** | (2006.01) |
| ***A62B 1/14*** | (2006.01) |
| ***B66D 1/74*** | (2006.01) |

(52) U.S. Cl.

CPC ..... *A62B 1/14* (2013.01); *B66D 1/7447* (2013.01); *B66D 1/7489* (2013.01); *B66D 1/7494* (2013.01)

(58) Field of Classification Search

USPC ..... 254/384, 385, 371, 362, 333

See application file for complete search history.

(56) References Cited

U.S. PATENT DOCUMENTS

| | | | | |
|---|---|---|---|---|
| 3,968,953 | A | 7/1976 | Guangorena | |
| 4,555,093 | A * | 11/1985 | Plummer | 254/362 |
| 6,042,086 | A * | 3/2000 | Roberts | B66D 1/7484 254/342 |
| 6,283,455 | B1 | 9/2001 | Ascherin et al. | |
| 6,412,602 | B1 * | 7/2002 | Sundman | 182/133 |
| 6,955,244 | B2 * | 10/2005 | Yerman | 182/142 |

(Continued)

FOREIGN PATENT DOCUMENTS

| | | |
|---|---|---|
| CN | 101337644 | 1/2009 |
| WO | 2006074250 A2 | 7/2006 |

(Continued)

OTHER PUBLICATIONS

PCT Search Report for PCT/IB2010/001313.

(Continued)

*Primary Examiner* — Emmanuel M Marcelo

(74) *Attorney, Agent, or Firm* — Brian G. Gilpin; Godfrey & Kahn, S.C.

(57) ABSTRACT

The invention regards to a portable ascender device (1) on a rope (8) comprising an actuation element (2), manual or motor-driven, a nautical winch (5) provided with a self-tailing (52), rotated by the actuation element (2), and at least one first forced passage (9) of the rope (8) in proximity to the winch (5). The first forced passage (9) is arranged upstream of the winch (5) with respect to the rope (8) winding direction. A method for hoisting oneself by means of such device (1) along a vertically stretched rope (8), and two methods for descending along the rope (8) by means of the same device (1), respectively in active mode and in passive mode, are also described.

15 Claims, 4 Drawing Sheets

(56) References Cited

U.S. PATENT DOCUMENTS

| | | | | |
|---|---|---|---|---|
| 7,717,402 | B2 * | 5/2010 | Mann | B66D 1/7484 242/397.2 |
| 2004/0112674 | A1 | 6/2004 | Yerman | |
| 2008/0203370 | A1 * | 8/2008 | Ball et al. | 254/372 |

FOREIGN PATENT DOCUMENTS

| | | | |
|---|---|---|---|
| WO | 2006113844 | A1 | 10/2006 |
| WO | WO2006113844 | | 10/2006 |

OTHER PUBLICATIONS

Office Action issued Dec. 4, 2013, in Chinese Appl. No. 201080050168.3.

Office Action from the State Intellectual Property Office of the People's Republic of China issued for Application No. 201080050168.3; mailed Sep. 18, 2014.

* cited by examiner

ROPE ASCENDER DEVICE AND METHOD FOR USE THEREOF

BACKGROUND

The present invention refers to a rope ascender device and to a method for use thereof by an operator.

Motorized devices that allow hoisting oneself, i.e. ascend, along a rope stretched vertically and fixed to a raised anchoring point are available in the market. Generally, the ascending devices referred to comprise a pulley and the respective actuation motor, which may be electric or of the internal combustion type. The seat for the rope obtained on the circumference of the pulley has, in cross-section, a rounded U-shape to allow maximum external surface of the rope to grip. Usually, the motor, with the corresponding battery or fuel tank, is fixed to a small framework having handles directly graspable by the user and rings for anchoring to a harness worn by the user himself. Once fixed onto the device, the user actuates the motor for winding—at least partly—the rope onto the pulley, causing vertical ascension thereof along the rope alongside the device itself.

The ascension controlled by motorized devices is often provided for in the mountain or well rescue operations, or in maintenance and inspection operations on pylons and generally in situations wherein there arises the need to hoist oneself vertically on a stretched rope, without effort. For example, motorized ascender devices are usually used by wind energy generators maintenance technicians for inspecting the blades or hoisting themselves onto the nacelle of the generators.

It is also known that such devices may also be used for hoisting people together with loads of material or equipment.

For example, a motorized ascender device is described in the European patent EP 1030726B1 granted to the Swedish company Act Safe Systems AB. Such device comprises a motor whose driving shaft is coupled to a pulley onto which the rope used for ascending is partly wound, or is wound without completing a loop, for example a half turn. The device further comprises a framework onto which a carabiner or closed ring is prearranged, positioned in proximity to the pulley. In the operative mode of the device, the rope is prearranged by the user in such a manner to pass through the carabiner, be wound around the pulley and pass through the same carabiner again. This configuration guarantees correct winding of the rope onto the pulley and hinders disengagement. The user controls the motor by means of a button to rotate the pulley in the winding direction on the rope, causing the raising of the device and the user secured thereto. The carabiner (or ring) is configured as a forced and closed passage for the rope both upstream and downstream of the pulley with respect to the winding direction. As a matter of fact, once inserted into the carabiner, the rope can no longer exit from the same and it is forced to wind around the pulley correctly.

Adjusting the direction of rotation of the pulley allows controlling not only the ascent but also the descent along the rope. In practice, the ascender device also serves as a motorized descender.

The presence of only one forced and closed passage upstream and downstream of the pulley, forces the rope to be wound on the pulley by half turn. The weight of the same device generates friction between the rope and the pulley, that is enough to hinder the respective sliding between these elements. This allows preventing inadvertent falling of the device and the respective user along the rope, due to the force of gravity, when the device is inoperative, i.e. when the pulley is stationary. In the operative mode described above, with the pulley stationary, the device is configured as an alpine descender of the passive type, i.e. a device that allows descending only if the user intervenes actively on the device, and in the specified example if the user commands the rotation of the pulley in the direction opposite to the ascension one.

Another ascender device having a pulley is described in the International patent application WO 2006/074250. In this embodiment, the pulley may support three turns at most; a forced passage for the rope upstream of the pulley and guide rollers of the rope are provided for on the pulley. The number of turns cannot be modified, in particular when the device is in use.

The devices described above, having a pulley, reveal some drawbacks. The main drawback is related to the low weight that these devices allow to be hoisted, determined by the fact that the winding of the rope around the pulley is shorter than a single turn, i.e. it is limited to less than a complete loop, or it is limited to two or three turns, corresponding to the number of special guide grooves present on the pulley. This configuration has a negative impact also on the wear of the rope.

Another drawback lies in the fact that should the motor fail to function (breakdown, lack of fuel or low battery), the ascender devices of the prior art do not allow the user to ascend. In this case, the user is forced to return to the ground, and in case of emergency the user might be forced to leave the device, which remains suspended, and use alpine descenders applied to the rope. International patent application number WO 2006/113844 describes a powered rope ascender device, provided with a winding drum of the rope in turns parallel and having constant diameter. The device comprises an eyelet for guiding the rope upstream of the winding drum and a return pulley which aligns the rope with respect to the winding drum. The eyelet is configured as a forced passage for the rope. A lever is pivoted to the body of the device and is provided with a series of guide rollers oriented with the respective rotational axis orthogonal to the axis of the drum. The lever is rotatable between a non-operative position, wherein the rollers are distant from the winding drum, and an operative position, wherein the rollers are substantially in abutment against the outer surface of the drum. When the lever is at the non-operative position, the rope may be positioned on the drum; by moving the lever to the operative position, the windings of the rope remain separate from each other, guided by the rollers, and they cannot move along the axis of the drum. The lever comprises a final roller oriented with the respective rotational axis parallel to the axis of the winding drum. The final roller has the task of compressing the exit end of the rope against the winding drum to exert tension sufficient to attain the grip of the turns of the same rope against the drum and, thus, to allow the operation of the ascender device without the rope slipping. The final roller compresses the rope only when the lever is blocked at the operative position thereof.

The device described in the patent application WO 2006/113844 does not allow modifying the configuration of the turns of the rope when the user is hoisted on the same or to slow the descent with the motor off—hence increasing the tension applied at the exit end of the rope —unless by using the hands. When the device is in use, the user cannot rotate the lever to the non-operative position to modify the number of turns (for example adding other turns on the winding drum) in that there would lack the minimum tension required to avoid the sliding of the turns on the drum. In other words, the rotation of the lever in the non-operative position would cause the fall of the user. Another drawback of this device lies in the fact that the structure thereof is complex. Furthermore, the initial position of the turns on the winding drum requires attention by the user, who should arrange the turns spaced for the insertion of the guide rollers therebetween.

Also available in the market are powered pulling devices serving to move loads, but not people, fixed to a rope, vertically or along slanting or uneven surfaces, for example along steep hills. The respective operation provides for anchoring against external structures, for example trees, poles, platforms, etc. and the return of the rope onto which the loads are secured. Generally, such devices are similar to those described previously, but instead of the pulley they are provided with a pulling drum, externally smooth and substantially cylindrical, around which the rope must be wound in several turns. With respect to a pulley, the drum is extended further along the respective rotational axis to allow the winding of at least one complete turn of the rope and preferably allow the winding of several turns in succession.

In particular, in the operative configuration of the pulling devices, the section of the rope under tension is guided by a hook positioned upstream of the drum with respect to the pulling direction, and it is wound in turns on the drum; the section of the rope not under tension leaves the drum substantially free or guided by a second hook, and it is guided manually by the user. The hook does not represent a forced and closed passage for the rope which may be easily disengaged if not guided correctly by the user.

Disadvantageously such devices, used always anchored to fixed structures, are not suitable for hoisting people in that in order to control the descent the user is required to manually exert a tension on the section of the rope coming out from the drum, i.e. the section not under tension comprised between the drum and the underlying ground; in other words the user is required to constantly hold the end of the rope coming out from the drum and apply at least a slight tension, to allow the rope to obtain grip onto the drum and to prevent sliding thereof. This event would lead to a non-controlled descent of the device and the user, with apparent risks for the safety of the user. Due to the need of a manual intervention of the user, the pulling devices would be configured as descenders of the active type, less safe with respect to the devices of the passive type and thus not used for hoisting people. Furthermore, such pulling devices are cumbersome and heavy, thus not suitable to be hoisted together with the user.

The ascender or pulling devices described above are prearranged to operate with ropes of the fabric type but not steel cables, which normally need to be gathered on the drum. In other known pulling devices, the rope of the fabric type or an equivalent steel cable are entirely wound on the pulling drum. Also these devices are not suitable for hoisting people, in that the drums have large dimensions.

The technical problem on which the present invention is based is that of providing an ascender device capable of being used also for pulling loads and such device being safe, simple and efficient under any condition of use and capable of allowing easily adjusting the tension that operates on the rope during ascent and descent.

Another technical problem is that of providing an ascender device of the aforedescribed type, capable of offering maximum comfort for the user.

BRIEF SUMMARY

Therefore, in its first aspect, the present invention regards a rope ascender device.

The device comprises means for at least partly winding up a rope, at least one element for rotating said winding means, and at least one first forced passage of said rope upstream of the winding means with respect to the rope winding direction, and it is characterised in that said winding means comprise at least one nautical winch provided with a winding drum and self-tailing, wherein the self-tailing comprises two circular half-shells, coupled opposite with respect to each other and integrally joined in rotation to the winding drum, a groove for accommodating the rope being configured therebetween.

Regarding the present invention, the rope winding direction is defined by the direction of formation of the turns on the winding drum. The rope is wound on the drum starting from the end of the drum at which the coupling with the motor is provided for.

The actuation element comprises a motor, for example of the electrical or internal combustion type, and/or a manually operated crank. In the preferred embodiment of the present invention, the actuation element of the winch is motor-driven and we shall hereinafter mainly refer to this embodiment for the sake of simplicity.

Advantageously the ascender device according to the present invention comprises a nautical winch provided with a self-tailing. This term is used to indicate a pulling element applied onto the winding drum, at the free end thereof, opposite to the end for coupling with the drive shaft.

In particular, the interior walls of the two half-shells of the self-tailing, which may be smooth or knurled, exert a pressure on the rope which increases proportionally to the insertion of the same rope into the accommodation groove. Thus, the self-tailing allows exerting a pulling tension on the rope without the manual intervention of the operator.

The device according to the present invention is of the portable type, i.e. intended to be hoisted on the rope together with the user. The device may also be used for the horizontal and/or oblique pulling of loads from the ground. Advantageously, the presence of the winding drum allows distributing the high tensions applied onto the rope on several turns. The device thus allows hoisting heavy loads, while simultaneously minimising the wear of the rope.

Given that levers and guide rollers or pulleys of the types used in the devices respectively described in patent application WO 2006/113844 and in patent application WO 2006/074250 are not provided for, the user may modify the number of turns wound on the winch, increasing or reducing them, without being exposed to risks.

The winch of the ascender device may be directly connected to the actuation element, for example the drive shaft of the motor. However, the winch is preferably coupled to the actuation element through gears which serve to multiply the exerted torque. The presence of the gears also allows setting the most suitable transmission ratio. For example, in cases where the actuation element is a motor, the respective drive shaft may rotate at high speeds without jeopardising the safety of the ascension, in that the actual rotation transmitted by the gears to the winding drum is lower due to the selected transmission ratio.

Preferably the ascender device comprises a second forced passage for the rope positioned downstream of the winding drum with respect to the rope winding direction and upstream of the self-tailing. In an alternative embodiment of the present invention the second forced passage is prearranged downstream of the self-tailing of the winch or at the self-tailing.

According to an embodiment of the present invention, the ascender device comprises, at the self-tailing of the winch, a shaped bracket for extracting the rope from the same self-tailing. In this event the second forced passage for the rope is formed on such shaped bracket, which is in turn preferably fixed to a non-rotatable fixed structure, of the winch. In this embodiment the second forced passage receives the rope from the winding drum and guides it into the self-tailing.

Preferably the forced passages provided for the rope upstream and/or downstream of the winding drum of the winch are made up of a ring, a carabiner, or elements equivalent thereto. More preferably they are rings, carabiners etc. of the openable type, for example of the alpine type. Rings, carabiners etc. are substantially circular or elongated-oval-shaped.

According to an embodiment of the invention, the ascender device comprises a framework for supporting the motor and/or the winch. The framework may be, for example, tubular. The anchors for the harness of the user are preferably obtained on the framework. In cases where the ascender device has an electric motor, the framework also bears the battery. In case of an internal combustion motor, the framework bears a fuel supply tank.

Preferably, the ascender device according to the present invention comprises a chair for the user, for example a seat. More preferably the seat is rigid (for example made of plastic) and it is coupled to the framework of the device, or the same framework is configured as a seat. This characteristic allows maximising the comfort of the device in use, in that the user may remain comfortably seated during ascent. Should ascent be performed also using the self-tailing, both hands of the user are free.

The term seat is used to indicate a rigid or solely partly flexible support, in any case distinct with respect to the fabric harness, such as for example an alpine harness.

Preferably the winch comprises a housing for removable coupling with a manually operated crank. This characteristic is important in terms of safety. Even in case of a motor malfunction, for example due to breakdown or lack of fuel or power, the user may complete ascension by actuating the winch manually. The user may carry a crank and use it if required, by inserting it into the special housing, to rotate the winch. In cases where the actuation element of the ascender device does not comprise a motor, the user actuates the winch using the manoeuvring crank.

In its second aspect, the present invention regards to a method for hoisting oneself, through the aforedescribed device, along a rope arranged vertically.

In particular, the method comprises the steps of:

a) fastening oneself to the ascender device;
b) passing the rope through said first forced passage,
c) winding it in one or more turns around the winding drum of the winch, characterised by the further steps of:

d) inserting the rope into the self-tailing of the winch, and
e) actuating the actuation element in the direction that makes the winch to ascend along the rope.

Advantageously the use of the self-tailing allows ascent without necessarily manually exerting tension onto the end of the rope coming out from the winch. The user may thus ascend along the rope having the hands free. The tensions applied are high and the wear of the rope is minimised or however acceptable.

Advantageously, also during the ascent the user may extract the rope from the self-tailing to manually exert—onto the exit end of the rope—the tension required to prevent slipping. The user may also interrupt the ascent and increase or reduce the number of turns wound on the winch, and then continue the ascent. This procedure is not applicable with the devices described in patent applications WO 2006/113844 and WO 2006/074250.

The user may easily use the aforedescribed ascender device also for descending vertically along the rope. In other words, the ascender device may also be configured as a descender, both in active and passive mode.

In its third aspect, the present invention thus regards a method for descending along a rope.

In particular, in its third aspect the invention regards a method for descending along a substantially vertical rope, through the portable ascender device described above, in active mode. The method comprises the steps of:

a) fastening oneself to the ascender device;
b) passing said rope through the first forced passage,
c) winding it in one or more turns around the winding drum, and is characterised by the further steps of f) passing the rope through the second forced passage, and
g) manually applying a tension on the end coming out from said winding drum to adjust the friction that is generated between the rope and the drum itself.

The user controls the speed of descent by controlling the tension applied manually onto the free end of the rope, i.e. the portion downstream of the winding drum and comprised between the drum itself and the ground. The tension applied by the user has a direct impact on the friction that is generated between the turns of the rope and the winding drum. Should the user not apply tension onto the rope, the same rope relatively slides on the surface of the winding drum, and the descender—together with the user—move rapidly downwards. Should the user apply even a minimum tension onto the rope, the friction that is generated between the turns of the rope itself and the winding drum is enough to slow or stop the unwinding of the rope.

In particular, in its fourth aspect the invention regards a method for descending along a substantially vertical rope, through the portable ascender device described above, in passive mode. The method comprises the steps of:

a) fastening oneself to said ascender device;
b) passing said rope through said first forced passage,
c) winding it in one or more turns around the winding drum, and is characterised by the further steps of f) passing the rope through the second forced passage,
h) winding said rope in one or more turns at said second forced passage, and
i) manually feeding the rope to said winding drum, through said second forced passage.

In the passive mode, a relative sliding between the rope and the winding drum does not occur unless the user intervenes feeding the rope to the winch, through the second forced passage. In the latter case, the friction between the rope and the winding drum is reduced just enough to obtain a sliding of the rope and the descent of the device and the user.

Should the second forced passage be formed by a carabiner or an equivalent element, the user may wind the rope into several loops around a portion of the carabiner for further securing the position thereof against the descent, providing for the sliding of the rope on the winding drum of the winch.

In addition, in order to interrupt the descent and stop at the intermediate height the user may strangle the rope in the self-tailing of the winch. The winch may rotate only in the direction that causes ascent along the rope, while rotations in the opposite direction are hindered. This allows improving the safety of the user further, especially when the loads applied to the rope are high.

Advantageously the ascender device according to the present invention has a simple structure and allows ascent and descent along a vertical rope under maximum safety conditions. In case of motor malfunction, the user may complete ascension by manually actuating the winch by means of the respective crank. The possible presence of the seat also confers to the device considerable comfort in use.

Further characteristics and advantages of the present invention shall be more apparent from the following detailed description of some preferred embodiments thereof, provided referring to the attached drawings. In such drawings,

DETAILED DESCRIPTION OF THE EMBODIMENTS

Figure 1:
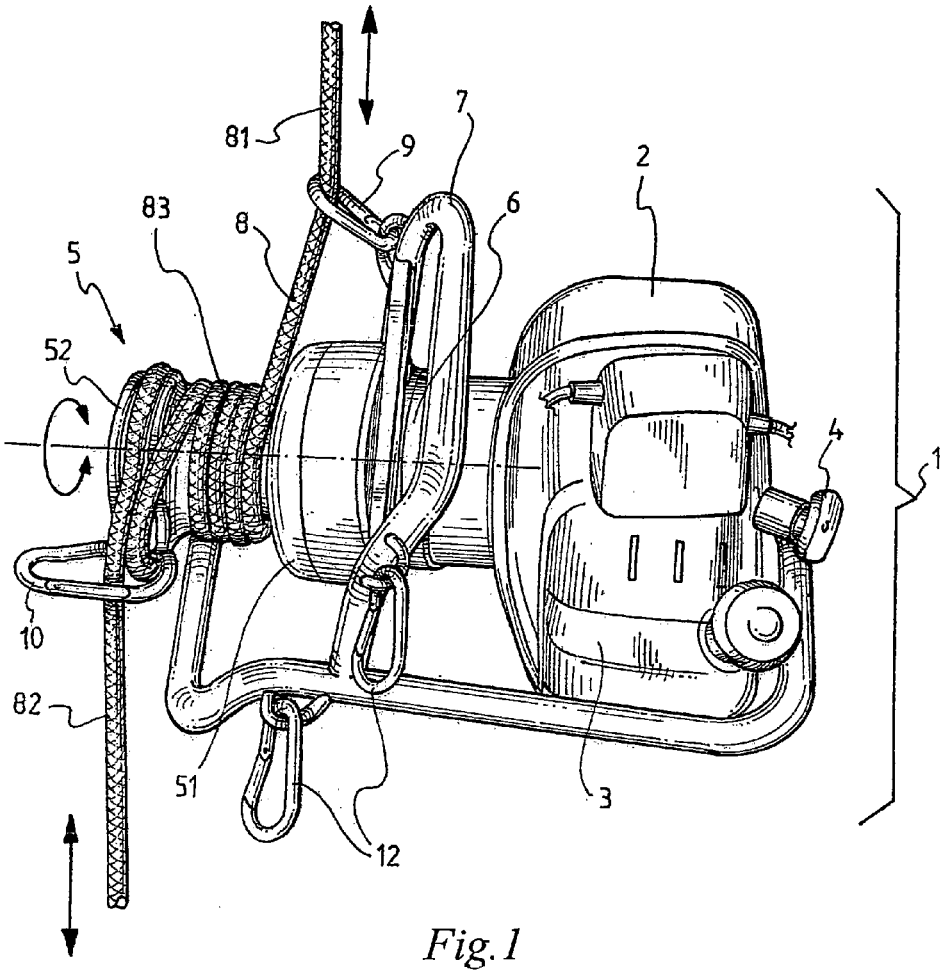
FIG. 1 is a side view of a first embodiment of the ascender device according to the present invention, in a first use configuration.

FIG. 1 shows a device 1, according to the present invention, intended to support the respective user when ascending along a rope prearranged in a substantially vertical or slanted position, for example on a metal structure such as a pylon, a pole or a tower, or along a steep hill.

Generally, the device comprises at least one actuation element 2, preferably a motor which may be electrical battery-powered or an internal combustion motor, fuelled by diesel, petrol or gasoline/lubricating oil mixture. In the embodiment shown in the figures, the motor 2 is an internal combustion motor and reference number 3 is used to indicate the fuel tank. Starting, of the pull start type, is performable by means of a cord 4.

Generally, the started motor 2 can be actuated by the user by means of a pushbutton panel, a remote control or an actuation lever etc. Preferably such control elements allow controlling the rotation of the shaft of the motor 2 in the two directions of rotations, selected by the user.

The ascender device 1 comprises at least one nautical winch 5, i.e. a winch of the type used on boats for tensioning lines and sheets. Contrary to the solutions used in the pulling devices, the winch 5 comprises a winding drum 51 and a self-tailing 52.

The self-tailing 52, known in the nautical industry, is preferably made up of two opposite half-shells 53 and 55 between which a groove 54 for accommodating a rope is defined. The self-tailing 52 is located at one end of the winding drum and rotates integral with the winding drum 51. A rope inserted into the groove for accommodating the self-tailing 52 is drawn in rotation integral to the same self-tailing 52. The slanted walls of the half-shells push the rope towards the accommodation base upon the increase of the traction force exerted onto the rope itself. Due to this characteristic, the self-tailing 52 allows applying a pulling tension onto the rope without the user having to intervene manually to grip the rope itself.

Preferably, as shown in the attached figures, the self-tailing 52 is provided with a bracket 11 for extracting the rope 8. The bracket 11 is fixed to the stationary portion of the winch 5 (not shown), i.e. the portion that does not rotate alongside the winding drum and remains fixed. The bracket 11 is shaped in such a manner to cause, locally, the exit of the rope 8 from the accommodation groove of the self-tailing 52 when the winch rotates.

In an embodiment, the coupling between the winch 5 and the motor 2 is direct: the shaft of the motor 2 is directly coupled to the winding drum 51, in such a manner that such elements rotate integrally at the same speed.

In a preferred embodiment of the present invention, the winch 5 is coupled to the shaft (not visible in the figures) of the motor 2 by means of transmission element 6 to gears. The gears are dimensioned to provide the desired transmission ratio between the shaft of the motor 2 and the winding drum 51. This characteristic is important for the safety of the use, in that it is possible to run the motor 2 to a number of revolutions corresponding to the maximum developed power, but still maintaining the winding speed of the winch 2 with respect to the rope acceptable.

Preferably, as shown in the attached figures, the device 1 is provided with a framework 7 which supports the motor 2, the winch 5 (at the base thereof), and the transmission and reduction element 6. In the illustrated embodiment, the framework 7 is of the tubular type, made of steel. The framework 7 may have different shapes and sizes, depending on the situation.

In an alternative solution, the body of the motor 2 also serves as a bearing structure and the device 1 is without a framework 7.

FIGS. 1-5 show a vertical rope 8. The upper end of the rope 8 is anchored, for example, at the top part of a pylon and the lower end is left loose on the ground. The user of the device 1 may use the winch 5 to ascend along the rope 8 to the desired height.

The rope 8 is wound on the drum 51 starting from the base of the winch 5, i.e. starting from the portion of the drum 51 facing the motor 2. The rope 8 is wound in one or more turns 83 around the drum 51 and, when required, into the self-tailing 52, before leaving the winch 5. The section of the rope 8 upstream of the drum 51 with respect to the winding direction is indicated with reference number 81 and during the use of the device 1 it is the section under tension. The section of the rope 8 downstream of the drum 51 with respect to the winding direction indicated with reference number 82 and during the use of the device 1 is the section not under tension, i.e. loose.

Generally, the device 1 is provided with at least one forced passage 9 positioned upstream of the winch 5 with respect to the rope winding direction 8 on the drum 51. The term forced passage is used to indicate a slot, even non-circular, limited laterally, i.e. closed, within which the rope 8 may slide, without exiting. Preferably the first forced passage is made up of a ring or a carabiner 9, for example openable, of the type used in alpine climbing. In the embodiment illustrated in the figures, a carabiner 9 is constrained to the framework 7 and it is crossed by the section 81 of the rope 8 under tension. The carabiner 9 prevents the rope 8 from winding in an incorrect manner on the drum 51; in practice it prevents the overlapping of the turns 83 and entangling the rope 8.

Preferably, the device 1 also comprises a second fixed passage 10 downstream of the winding drum and upstream of the self-tailing, and/or at least one fixed passage downstream of the self-tailing 52. Also the second fixed passage is preferably made up of an openable carabiner 10. In the embodiment shown in the attached figures, the carabiner 10 is fixed to, or made in a single piece with, bracket 11, and it is thus stationary, i.e. it does not rotate together with the drum 51 and the self-tailing 52.

Generally, the ascender device 1 may have two or more second forced passages, arranged in succession, for example each constituted by a ring or a carabiner.

The presence of the second forced passage 10 allows maximising the safety of the ascent and the descent along the rope 8 under all use conditions, allowing the user the best management of the end 82 of the rope 8 not under tension.

Figure 2:
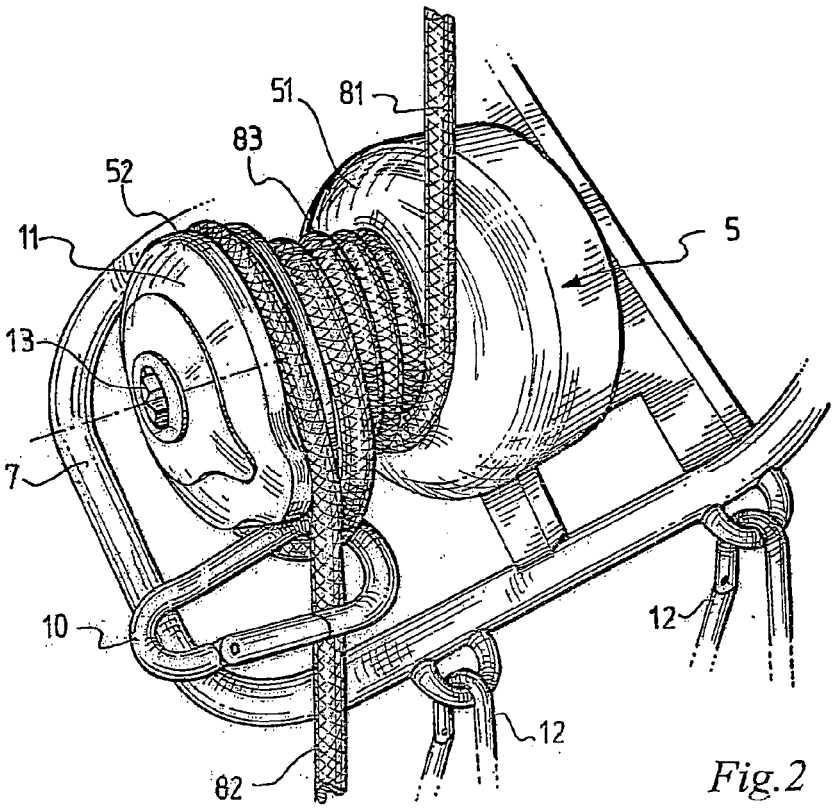
FIG. 2 is a perspective view of a detail of the ascender element shown in FIG. 1, in the first use configuration.

Referring to FIGS. 1-2, the ascent of the user along the rope 8 is actuatable as follows. The user, previously harnessed, is anchored onto the ascender device 1, by means of further carabiners 12 welded to the framework 7. The user passes the rope 8 through the first carabiner 9 and winds it in turns 83 around the winding drum 51. Manually holding the rope 8 coming out from the winding drum 51 in tension the user may actuate the motor 2 to control the rotation of the winding drum in the direction that takes the device 1, and the user himself, to be hoisted along the rope 8. Advantageously, as shown in FIGS. 1 and 2, in order to improve the ascent safety, the user inserts the rope 8 through the second forced passage 10 downstream of the winding drum 51. This allows guiding the rope 8 better and preventing hazardous movements of the turns 83 with respect to the winding drum 51; in case of malfunctions causing an undesired descent, the user may intervene timely by manually diverting the trajectory of the rope 8 to increase the friction that is generated between the same rope 8 and the second forced passage 10, thus slowing or stopping the descent. In addition, the user may also insert the rope 8 into the self-tailing 52 to facilitate the gripping of the rope 8 onto the winch 5 when the load constituted by the user and the respective equipment is hoisted. The self-tailing 52 cooperates with the turns 83 to optimize the grip of the winch 5. When the self-tailing 52 is active, the user may, if desired, release the rope 8 and have the hands free, still completing the ascent.

In particular, in FIGS. 1 and 2' the rope 8 leaves the self-tailing 52 and once again crosses the second carabiner 10 with the portion 82 not under tension (the rope 8 passes twice through the carabiner 10). In case of a malfunction of the motor 2 or unwanted sliding of the rope 8 into the self-tailing 52 or onto the winding drum 51, the user may prevent or stop the rapid ascent along the rope 8 diverting the end 82 of the rope 8 against the carabiner 10. Thus, it is possible to transmit a tension onto the rope 8 which leads the turns 83 to tighten on the drum 51.

Figure 3:
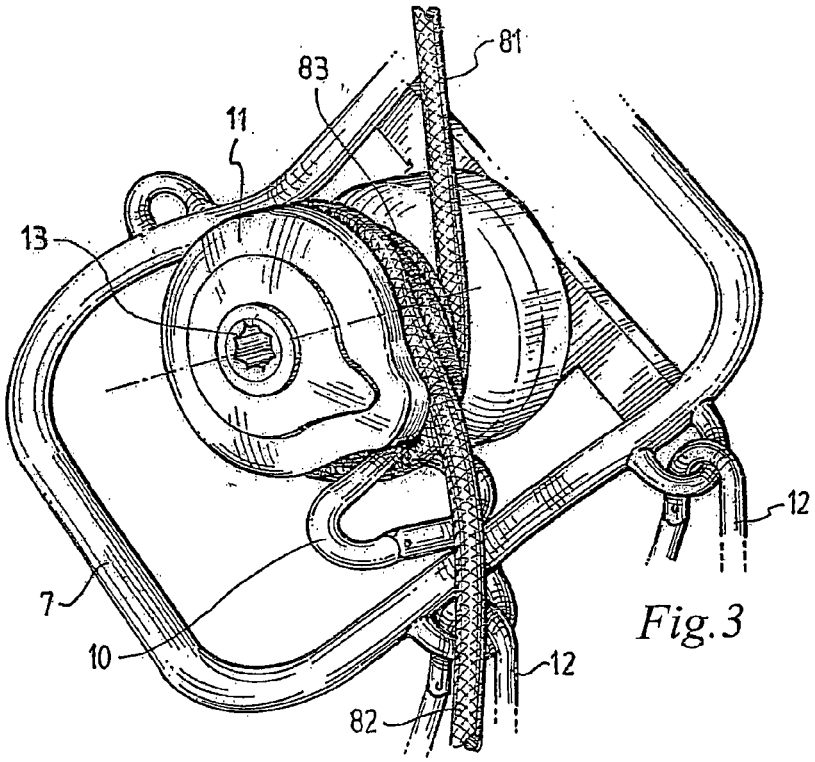
FIG. 3 is a perspective view of a detail of the ascender element shown in FIG. 1, in a second use configuration.

FIG. 3 shows the device 1 in a second use configuration during the ascent on the rope 8. In this configuration, the rope 8 crosses the first forced passage 9, is wound on the drum 51 and crosses the carabiner 10 only once before being wound onto the self-tailing 52; the end 82 of the rope 8 not under tension does not cross the carabiner 10; the self-tailing 52 keeps the rope 8 under tension just enough to prevent the sliding of the turns 83 relatively to the surface of the drum 51.

The descent may be performed with the motor 2 OFF, if a suitable mechanism is present, with the motor 2 ON but idle, i.e. with the shaft not engaged with the winch 5. The winding drum 51 may rotate in the direction that could cause the device 1 to ascend along the rope 8, but rotation in the opposite direction is prevented due to the structure of the winch 5 itself.

Figure 4:
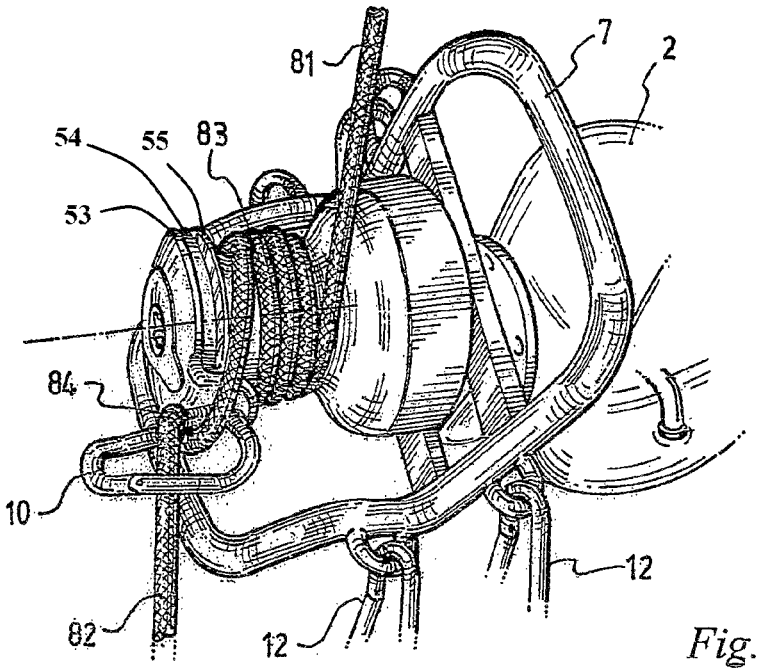
FIG. 4 is a perspective view of a detail of the ascender element shown in FIG. 1, in a third use configuration.

The user performs the descent in active mode as follows. Remaining anchored to the device 1, with the drum 51 immobile, the user manually extracts the rope 8 from the self-tailing 51 and slides the end 82 of the rope 8 not under tension in the hand thereof. In this configuration, the rope 8 slides relatively to the drum 51 and the device 1 descends along the rope 8. When the user applies tension —even minimum—on the end 82 of the rope 8, the turns 83 tighten on the winding drum 51 and descent is interrupted or slowed. In order to have greater control on the speed of descent, should the grip of the rope 8 on the drum 51 not be enough (slippery rope or drum, or high load), the user may wind the end 82 around the carabiner 10, as shown in FIG. 4, to create a turn 84. However, the descent remains active, in that the turn 84 slides around the corresponding portion of carabiner 10 until the user intervenes to subject the end 82 of the rope 8 to tension. However, the presence of the turn 84 guarantees an efficient braking of the vertically stretched rope when the rope 8 tends to slide on the drum 51, for example due to dust or dirt present on the rope and/or on the drum or in the presence of high loads, or when the number of turns 83 is not enough.

Figure 5:
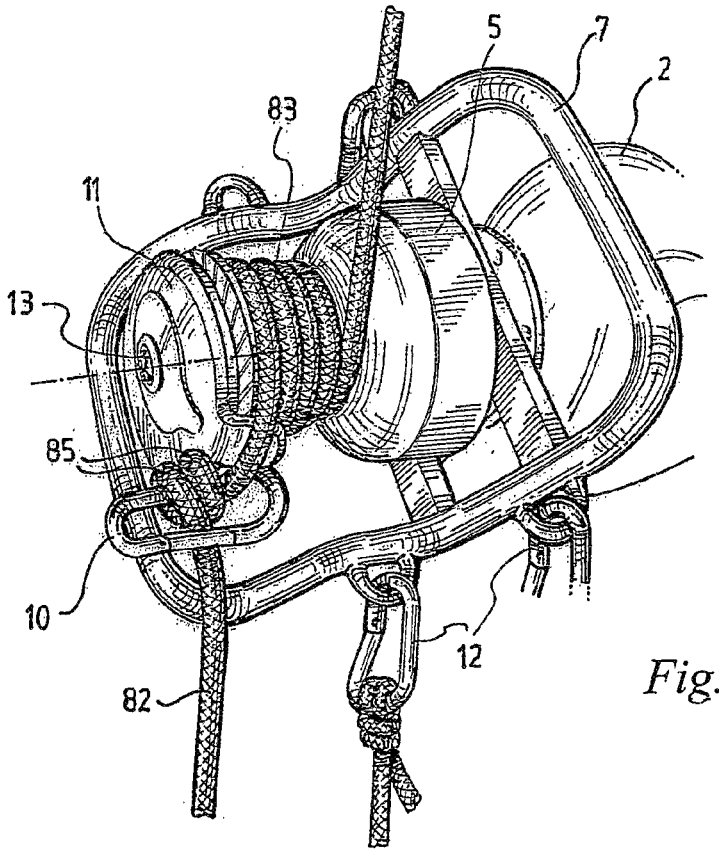
FIG. 5 is a perspective view of a detail of the ascender element shown in FIG. 1, in a fourth use configuration.

FIG. 5 shows the device 1 in a fourth use configuration during the passive descent along the rope 8. In this configuration, the end 82 of the rope 8 is wound around the carabiner 10 in one (if the grip of the rope 8 on the drum 51 is satisfactory) or more turns 85. The descent along the rope 8 is possible only if the user manually feeds the rope 8 to the carabiner 10, i.e. if the user in question at least partly loosens the grip of the turns 85 on the carabiner 10. Should the user not intervene, the descent along the rope 8 is not possible; as a matter of fact, the turns 85 themselves generate in the rope 8 a tension sufficient to tighten the turns 83 on the winding drum 51, preventing the relative sliding of the rope 8 with respect to the winch 5. Thus, the user may operate using both hands, stopping at the desired height along the rope 8, without caring to control the tension on the rope 8.

Preferably, as shown in FIGS. 1-5, the device 1 is provided with a housing 13 for removable coupling with a crank (not shown) for manual actuation of the winch 5. The crank is insertable and lockable in the housing 13 and allows an easy rotation of the winding drum 51 and the self-tailing 52 even when the motor 2 is not present, or it is OFF or non-operative. This allows the user to complete the ascent even in case of non-operativeness of the motor 2. The use of the crank is unadvisable when the motor 2 is running, given that the crank could be drawn in rotation and could hit the user, the equipment thereof or interfere with the winding and the unwinding of the rope 8.

Figure 6:
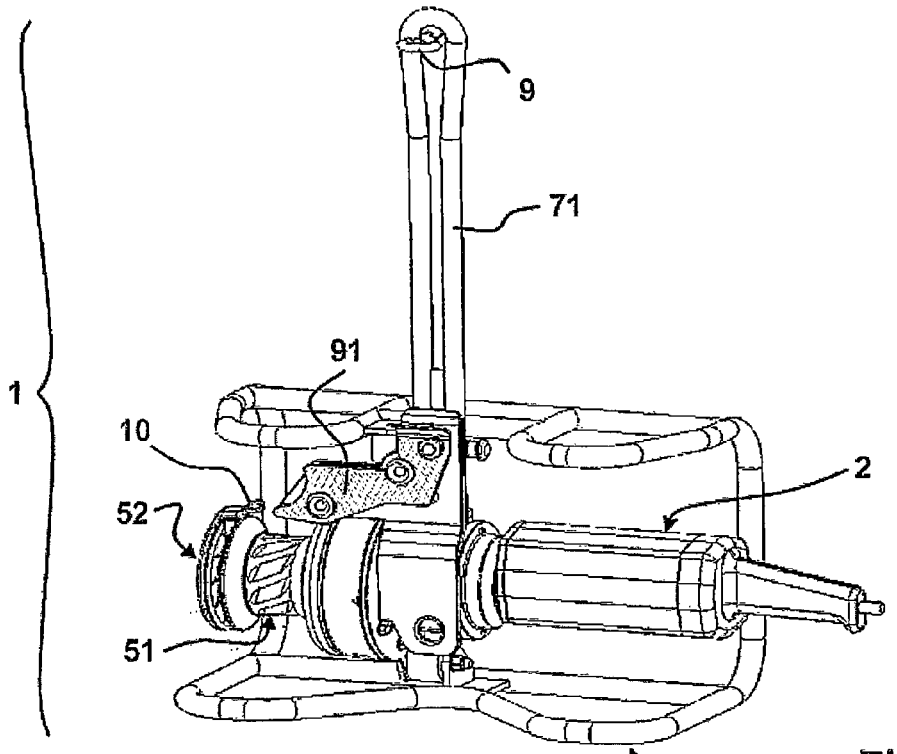
FIG. 6 is a perspective view of a second embodiment of the ascender device according to the present invention.
Figure 7:
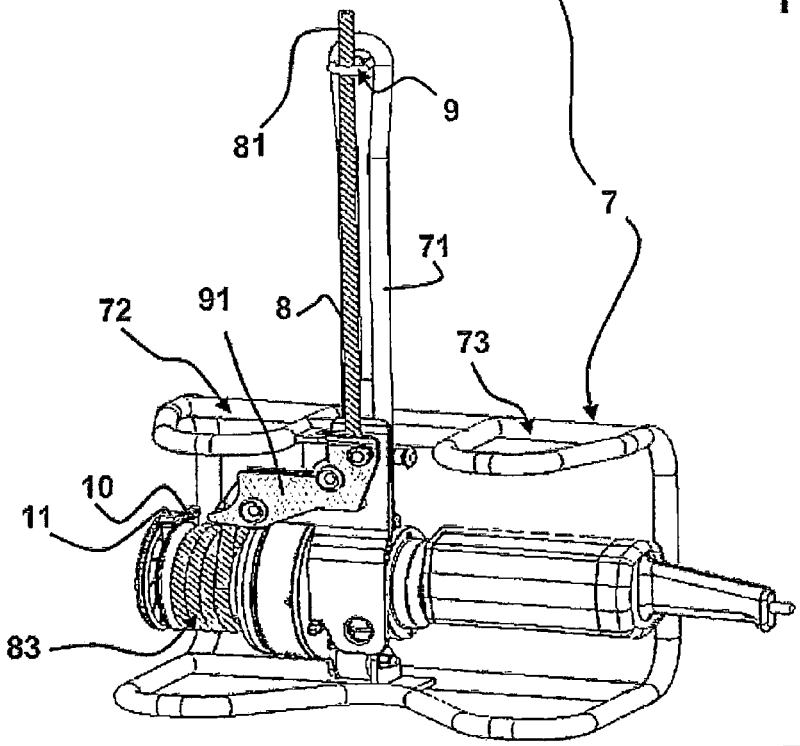
FIG. 7 is a perspective view of the device shown in FIG. 6, associated to a rope.

FIGS. 6 and 7 show a perspective view of a second embodiment of the device according to the present invention, provided with a seat for the user.

In the shown examples, the same framework 7 for supporting the motor 2 and the winch 5 is configured to allow the user to sit astride the framework itself. In particular, the framework 7 comprises a vertical handle 71 which the user can grasp for support and two horizontal arc-shaped portions 72, 73 for supporting the legs of the user which are extended laterally with respect to the handle 71 while the user is seated.

Alternatively, the framework 7 may have a different shape, for example the one shown in FIGS. 1-5 and a seat (not shown) for the user may be coupled to the framework 7.

Indicated with reference number 91 is a device for returning the rope 8 which has the function of diverting the rope 8 from the vertical trajectory to a horizontal trajectory for winding on the winch 5. For this purpose, the idler device 91 is provided with one or more rollers and with a cage for containing the rollers themselves (observable in the figures).

In FIG. 6 the rope 8 is not shown and the non-smooth surface of the winding drum 51 of the winch 5 is shown. In FIG. 7 the path of the rope 8 and the operation of the idler device are apparent.

The operation of the device 1 shown in FIGS. 6 and 7 is equivalent to the operation of the device shown in FIGS. 1-5 and elements identical or equivalent to the two embodiments are indicated with the same reference numbers.

The invention claimed is:

1. A rope ascender device comprising:

winding means for at least partially winding up a rope, the winding means comprising at least one nautical winch provided with a winding drum and a self-tailing arrangement separate from the winding drum wherein the self-tailing arrangement comprises two circular half-shells coupled opposite to each other and fixedly connected at one end of the winding drum in rotational connection to the winding drum, between which a rope housing groove is defined, at least one operating element for operating the winding means in rotation, at least one first forced passage of the rope upstream of the winding means with respect to the winding direction of the rope, and a second forced passage downstream of the winding drum and upstream of the self-tailing arrangement, with respect to the winding direction of the rope.

2. The rope ascender device of claim 1, wherein the second forced passage is arranged at the self-tailing arrangement of the winch.

3. The rope ascender device of claim 1, further comprising: a shaped bracket at the self-tailing arrangement of the winch for extracting the rope from the self-tailing arrangement, the second forced passage formed on the shaped bracket.

4. The rope ascender device of claim 1, wherein each forced passage provided for the rope is one of a ring or an openable carabiner.

5. The rope ascender device of claim 4, wherein the ring or openable carabiner has a substantially circular or elongated shape.

6. The rope ascender device of claim 1, wherein the operating element further comprises one of a motor or a manually operated crank.

7. The rope ascender device of claim 6, wherein the winch is connected to one of a drive shaft of the motor directly or a drive shaft of the motor through torque-multiplying gears.

8. The rope ascender device of claim 1, wherein the winch includes a housing for a removable coupling with a manually operated crank.

9. The rope ascender device of claim 1, wherein surfaces on the winding drum of the winch and surfaces on the self-tailing arrangement in contact with the rope are knurled.

10. The rope ascender device of claim 1, further comprising a framework for supporting the operating element and the winch.

11. The rope ascender device of claim 10, further comprising a seat for a user of the rope ascender device, the seat coupled to the framework.

12. The rope ascender device of claim 10, wherein the framework is shaped to support a user of the rope ascender device while seated.

13. A method for hoisting oneself, by means of an ascender device along a rope arranged generally vertically, the ascender device including winding means for at least partially winding up the rope, the winding means comprising at least one nautical winch provided with a winding drum and a self-tailing arrangement separate from the winding drum wherein the self-tailing arrangement comprises two circular half-shells coupled opposite to each other and fixedly connected at one end of the winding drum and in rotation connection to the winding drum, between which a rope housing groove is defined, at least one operating element for operating the winding means in rotation, and at least one first forced passage of the rope upstream of the winding means with respect to the winding direction of the rope, and a second forced passage downstream of the winding drum and upstream of the self-tailing arrangement, with respect to the winding direction of the rope, the method comprising the steps of:

a) fastening oneself to the ascender device;

b) passing the rope through the first forced passage;

c) winding the rope in one or more turns around the winding drum;

d) passing the rope through the second forced passage;

e) inserting the rope into the self-tailing arrangement of the winding means; and, f) actuating the operating element in a direction that makes the winch hoist along the rope.

14. A method for lowering oneself, by means of an ascender device along a rope arranged generally vertically, the ascender device including winding means for at least partially winding up the rope, the winding means comprising at least one nautical winch provided with a winding drum and a self-tailing arrangement separate from the winding drum wherein the self-tailing arrangement comprises two circular half-shells coupled opposite to each other and fixedly connected at one end of the winding drum and in rotation connection to the winding drum, between which a rope housing groove is defined, at least one operating element for operating the winding means in rotation, and at least one first forced passage of the rope upstream of the winding means with respect to the winding direction of the rope, and a second forced passage downstream of the winding drum and upstream of the self-tailing arrangement with respect to the direction of winding of the rope, the method comprising the steps of:

a) fastening oneself to the ascender device;

b) passing the rope through the first forced passage;

c) winding the rope in one or more turns around the winding drum;

d) passing the rope through the second forced passage; and e) manually applying a tension on an end of the rope coming out from the winch to adjust friction that is generated between the rope and the winding drum.

15. A method for lowering oneself, by means of an ascender device along a rope arranged generally vertically, the ascender device including winding means for at least partially winding up the rope, the winding means comprising at least one nautical winch provided with a winding drum and a self-tailing arrangement separate from the winding drum wherein the self-tailing arrangement comprises two circular half-shells coupled opposite to each other and fixedly connected at one end of the winding drum and in rotation connection to the winding drum, between which a rope housing groove is defined, at least one operating element for operating the winding means in rotation, at least one first forced passage of the rope upstream of the winding means with respect to the winding direction of the rope, and a second forced passage downstream of the winding drum and upstream of the self-tailing arrangement with respect to the direction of winding of the rope, the method comprising the steps of:

a) fastening oneself to the ascender device;

b) passing the rope through the first forced passage;

c) winding the rope in one or more turns around the winding drum;

d) passing the rope through the second forced passage; and, e) manually feeding the rope to the winding drum, through the second forced passage.

* * * * *